US010358747B2

(12) United States Patent
De Medts et al.

(10) Patent No.: US 10,358,747 B2
(45) Date of Patent: Jul. 23, 2019

(54) PULLEY FOR INSTALLATION IN A PULLEY MECHANISM OF A JACQUARD MACHINE

(71) Applicant: NV MICHEL VAN DE WIELE, Kortrijk/Marke (BE)

(72) Inventors: Frederik De Medts, Ooigem (BE); John Andrew Griffiths, Newcastle (GB); Matthew Theobald, Whittonstall-northumb (GB)

(73) Assignee: NV MICHEL VAN DE WIELE, Kortrijk/Marke (BE)

( * ) Notice: Subject to any disclaimer, the term of this patent is extended or adjusted under 35 U.S.C. 154(b) by 0 days.

(21) Appl. No.: 15/545,542

(22) PCT Filed: Jan. 20, 2016

(86) PCT No.: PCT/IB2016/050271
§ 371 (c)(1),
(2) Date: Jul. 21, 2017

(87) PCT Pub. No.: WO2016/116873
PCT Pub. Date: Jul. 28, 2016

(65) Prior Publication Data

US 2018/0044821 A1 Feb. 15, 2018

(30) Foreign Application Priority Data

Jan. 22, 2015 (BE) ..... 2015/5033

(51) Int. Cl.
*D03C 3/24* (2006.01)
*D03C 3/00* (2006.01)

(52) U.S. Cl.
CPC ..... *D03C 3/24* (2013.01); *D03C 3/00* (2013.01)

(58) Field of Classification Search
CPC ... D03C 3/20; D03C 3/24; D03C 3/06; D03C 3/12; D03C 3/36
See application file for complete search history.

(56) References Cited

U.S. PATENT DOCUMENTS 3,115,900 A * 12/1963 Egli ..... D03C 3/24 139/85
5,666,999 A * 9/1997 Dewispelaere ..... D03C 3/20 139/455

(Continued)

FOREIGN PATENT DOCUMENTS

CH 367 452 A 2/1963
CH 380 046 A 7/1964

(Continued)

OTHER PUBLICATIONS

International Search Report and Written Opinion dated Jun. 20, 2016.

*Primary Examiner* — Robert H Muromoto, Jr.
(74) *Attorney, Agent, or Firm* — Symbus Law Group, LLC; Clifford D. Hyra

(57) ABSTRACT

A pulley for installation in a pulley mechanism of a Jacquard machine has a shaft, a housing having two flank bodies, which are provided to fasten the shaft, so that this shaft extends substantially between the flank bodies, and a pulley wheel, which is provided to be arranged between the two flank bodies so as to be directly rotatable around the shaft. The shaft, prior to assembly of the pulley, is provided with cavities and/or projecting portions for the post-assembly axial securement of the flank bodies in both axial directions.

16 Claims, 5 Drawing Sheets

(56) References Cited

U.S. PATENT DOCUMENTS

| | | | | |
|---|---|---|---|---|
| 6,085,803 | A * | 7/2000 | Dewispelaere | D03C 3/06<br>139/455 |
| 6,382,263 | B2 * | 5/2002 | Dewispelaere | D03C 3/24<br>139/455 |
| 7,464,729 | B2 * | 12/2008 | Vanderjeugt | D03C 3/36<br>139/55.1 |

FOREIGN PATENT DOCUMENTS

| | | |
|---|---|---|
| CN | 203 229 633 U | 10/2013 |
| IT | EP 0 526 820 A1 | 2/1993 |

* cited by examiner

PULLEY FOR INSTALLATION IN A PULLEY MECHANISM OF A JACQUARD MACHINE

This application claims the benefit of Belgian patent application No. 2015/5033, filed Jan. 22, 2015, which is hereby incorporated by reference in its entirety.

FIELD OF INVENTION

This invention relates to a pulley for installation in a pulley mechanism of a Jacquard machine, comprising

- a shaft;
- a housing, comprising two flank bodies, which are provided to fasten the shaft, so that this shaft extends substantially between the flank bodies and so that the flank bodies are axially secured with the aid of the shaft in both axial directions;
- and a pulley wheel, which is provided to be arranged between the two flank bodies so as to be directly rotatable around the shaft.

In addition, this invention relates to a pulley mechanism for a Jacquard machine, which pulley mechanism comprises a pulley according to this invention.

Furthermore, this invention also relates to a Jacquard machine which comprises a pulley mechanism according to this invention.

BACKGROUND

As described, for example, in WO 2014/076558 A2, Jacquard machines are used to bring the warp threads in a weaving machine into the correct position per weaving cycle in order to realize, in combination with the weft threads, a desired weave structure having a desired pattern. The warp threads are brought into the desired position with the aid of pulley mechanisms. In a pulley mechanism of this type, a pulley is provided with an upper and a lower pulley wheel. Examples of such pulleys are known, for example, from CH 380 046 A, CN 203 229 633 U, EP 0 526 820 A1 and CH 367 452 A.

Pulley mechanisms of this type are used, for example, in Jacquard machines for moving the warp threads of single-piece, flat looms. In this case, an upper pulley cord is passed around the upper pulley wheel in, this cord is provided with two corresponding hooks (complementary set of hooks), which can selectively move in tandem, for example in counterphase, with two corresponding knives, wherein the motion of the corresponding hooks is translated via the upper pulley cord into a rotation of the upper pulley wheel. By influencing of the hooks with the aid of one or more associated selectors, for example electromagnetic selectors, the hooks are secured in their uppermost or in their lowermost position (depending on the design) for the duration of one or more weaving cycles. Around the lower pulley wheel a lower pulley cord is passed, which is connected at one end to one or more heddles, which are provided with an opening (heddle eye), through which a warp thread runs, for adjustment of the position of this warp thread. Such a heddle is spring-loaded, whilst the other end of the lower pulley cord is held at a well-defined position in the Jacquard machine.

A similar pulley mechanism is used in multi-rapier weaving machines, which are provided to be able to introduce more than one weft per weaving cycle at different weft insertion levels. The associated pulley mechanism can then comprise a plurality of pulleys and/or extra reversing wheels.

In view of the increasing trend to weave fabrics of higher densities and/or to provide more colours in a fabric, higher and higher requirements are being imposed on Jacquard machines regarding the number of pulley mechanisms which, for a same volume, can be accommodated in a Jacquard machine. All solutions for making a Jacquard machine more compact are consequently of particularly great importance. In order to be able to achieve this, the pulleys are preferably designed as light and as cheap as possible, whilst they have to be able to take up as much load as possible per unit of volume.

Various pulleys have already been developed with this object in mind.

In a first known compact pulley, the pulley wheels are formed by moulding a plastics wheel disc around a central upright flange of a metal shaft. This upright flange, which is provided on the centre of the metal shaft, forms in this way the core of the pulley wheel. Two flank bodies, which form a housing for this pulley, are provided with recesses in which the ends of the shaft are rotatably fitted, so that the shaft, with the pulley wheel fastened centrally hereto, is arranged rotatably with respect to these flank bodies. For this purpose, the flank bodies must however be designed sufficiently rigid.

In a second, yet more compact known pulley the metal shafts are hence clamped in recesses of the flank bodies, wherein plastics pulley wheels are fitted rotatably around these shafts. By virtue of the clamping, the flank bodies are in this way also axially secured by the shafts. At the ends of these shafts, the flank bodies cannot be displaced outwardly or inwardly in the pulley, since the clamping with the shafts prevents this. As a result of this axial securement, these flank bodies can themselves be designed less rigid, and thus more compact and/or lighter and/or cheaper, or this pulley can have a longer working life for a same compactness.

SUMMARY

An object of embodiments of this invention is to further increase the compactness of such a pulley or, given a same compactness, to further increase the working life of such a pulley.

This object may be achieved by providing a pulley for installation in a pulley mechanism of a Jacquard machine, comprising

- a shaft;
- a housing, comprising two flank bodies, which are provided to fasten the shaft, so that this shaft extends substantially between the flank bodies and so that the flank bodies are axially secured with the aid of the shaft in both axial directions;
- and a pulley wheel, which is provided to be arranged between the two flank bodies so as to be directly rotatable around the shaft;

wherein the shaft, prior to assembly of the pulley, is provided with cavities and/or projecting portions for the post-assembly axial securement of the flank bodies.

In order, in the above-described known pulley, to realize the axial securement of the flank bodies by the shaft, the clamping of the shaft in the flank bodies must be realized over a sufficiently large distance. According to this, the shaft is divided on its outer side into a zone (working portion), around which the corresponding pulley wheel is rotatably arranged, and a zone (holding portion), which is clamped in place by the flank bodies.

By now providing the shaft with cavities and/or projecting portions for the axial securement of the flank bodies, this holding portion on the outer periphery of the shaft can be considerably shortened or even eliminated, this if the connection between the flank bodies and the shaft is no longer realized along the outer periphery of the shaft, but only via cavities with access openings at the ends of the shaft. In this last case, only an internal holding portion on the inner side of the shaft is provided, and no longer a holding portion on the outer periphery of the shaft. However, there are also a lot of embodiments according to the invention in which the holding portion is still situated only on the outer periphery of the shaft, or partly on the outer periphery and partly on the inner side of the shaft.

By limiting or eliminating the holding portion on the outer side of the shaft, the shafts can for the same pulley wheels be designed shorter and the flank bodies can be designed less rigid. Both components (shafts and flank bodies) can be designed lighter. The whole becomes more compact for the same pulley wheels. If a same compactness as in the prior art is assumed, then a pulley having a longer working life can be obtained by virtue of the working portion of the shaft being able to be enlarged relative to the holding portion in comparison with the pulley of the prior art.

The cavities and/or projecting portions of such a pulley according to the invention can assume a variety of forms, such as, for example, notches or constrictions in the outer periphery of the shaft, bulges or thickenings on the outer periphery of the shaft, cavities in the centre of the shaft with access openings at the ends of the shaft, which access openings, in turn, can also be provided with notches, constrictions, bulges and/or thickenings, etc.

In order to be able to speak of a cavity, this must form an empty space within the shaft. This must for this purpose preferably be bounded on at least two opposite sides.

Such a shaft can be realized in one-part or multipart design in order thus to provide the necessary cavities and/or projecting portions.

In a preferential embodiment of a pulley according to this invention, the shaft comprises at both its ends an access opening to a said cavity in the shaft, and the flank bodies are provided to, via this access opening, engage in the respective cavity. In this way, at least a part of the holding portion of the shaft can be provided inside the shaft instead of outside.

Preferably, such a shaft is in this case provided with a cavity extending through the shaft, as the said cavity. Still more preferentially, such a shaft here comprises a uniform cross section in order to make the production thereof considerably simpler. Such a shaft can then be produced, for example, by drawing or by extrusion. In this case, it can advantageously be produced from metal. In a number of sectors, such hollow shafts of small diameter (less than 3 mm, down to about 2 mm) are used, inter alia in hydraulic applications, in precision instruments, in control apparatus, etc. Moreover, the high availability hereof guarantees the possibility of realizing a high-quality product as regards material type, workmanship, roughness (Ra values up to maximally 0.4 μm), dimensions, etc., and this for a reasonable price.

Such a shaft of uniform cross section is further preferably designed as a circular cylinder having a concentric cylindrical cavity.

In one particular embodiment of a pulley according to this invention, the flank bodies are provided for the frictional clamping of the shaft.

If a frictional clamping between the flank bodies and the shaft is provided, then the shaft is preferably provided at both its ends with an access opening to a said cavity in the shaft, and for this purpose each flank body comprises a projection, which is provided to, via the respective access opening, engage in the respective cavity in order to clamp the shaft frictionally.

With a frictional clamping on the inner side of the shaft instead of on the outer side of the shaft—such as in the prior art—a larger part of the outer side of the shaft can be used as the working portion for the rotation of a pulley wheel around the said shaft. The shaft itself can be designed lighter by virtue of being of hollow design. The inner side of the shaft, too, is now used, this as the holding portion. The useful length of the shaft (internal and external) hereby becomes a lot larger.

Particularly preferentially, the said projections of the flank bodies together clamp the shaft over virtually the full inner surface of this shaft, so that the useful length of the shaft is maximized.

The said projections of the flank bodies can advantageously be realized in hollow design. The cavity of these projections can provide for cooling, or an extra clamping element can be fitted in this cavity in order to realize a securement.

In a specific embodiment of a pulley according to this invention, the shaft is provided with a radial constriction as the said cavity and/or with a radial thickening as the said projecting portion.

It is also possible to provide a shaft of a pulley according to this invention with one or more local cavities and/or projecting portions as the said cavities and/or projecting portions. The fact that local cavities and/or projecting portions of this type are provided locally means that these can also easily, without clamping, provide for radial securement of the shaft. The flank bodies must then be provided with projections and/or cavities having a shape corresponding to the shape of these local cavities and/or projecting portions in the shaft.

In a preferential embodiment of a pulley according to this invention, the flank bodies are provided to radially secure the shaft. This radial securement can be realized, for example, with a clamping or, for example, as described above, with the aid of local cavities and/or projecting portions in the shaft and corresponding projections and/or cavities in the flank body.

The shaft of a pulley according to this invention can advantageously be connected to the flank bodies by press fit.

In order to reduce friction between the shaft and the pulley wheel, the shaft is preferably provided with a coating. This coating is preferably a porous coating, so that the shaft, by virtue of this coating, can retain lubricant even better.

The pulley wheel and the flank bodies are preferably provided with respective grooves and ribs, which together form a labyrinth seal in order to be able to better retain lubricant.

The shaft has further preferably a higher resistance to wear than the pulley wheel.

The pulley wheel is preferably made of plastic.

The housing of a pulley according to this invention is likewise preferably made of plastic. The lighter and less rigid flank bodies can be produced from a cheaper plastic.

Preferentially, the housing is produced by injection moulding. This allows a cheaper choice of material, given that injection moulding of less high-performance plastics runs more quickly and easily.

At least one flank body of a pulley according to this invention preferably comprises a groove, for the securement of a pulley cord passed around the pulley wheel. This groove preferably extends transversely to the longitudinal direction of the shaft over the whole of the flank body and here preferably runs, starting from one side of the flank body, through to the opposite side thereof. This groove preferably assumes the same curved shape in which the pulley cord is passed around the pulley wheel.

The housing of a pulley according to this invention is further preferably of two-part design, wherein each flank body forms part of a respective part of the two-part housing. This allows a smooth assembly of the pulley.

The two parts of the two-part housing are preferably virtually identical, so that exchanging of the two parts has no influence on the assembly.

These two parts of the two-part housing are further preferably mutually connected using a press fit and/or a click connection, so that an assembly is possible without bonding, heating or extra fastening means, etc.

An object of this invention is additionally also achieved by providing a pulley mechanism which comprises an above-described pulley.

Furthermore, an object of this invention is also achieved by providing a Jacquard machine which comprises such a pulley mechanism.

BRIEF DESCRIPTION OF THE DRAWINGS

This invention is now explained in greater detail on the basis of the hereinafter following detailed description of an embodiment of a pulley according to this invention. The aim of this description is solely to provide illustrative examples and to indicate further advantages and particularities of this pulley, and can thus not be interpreted as a limitation of the field of application of the invention or of the patent rights claimed in the claims.

In this detailed description, reference is made by means of reference numerals to the accompanying drawings, wherein in FIG. 1 a pulley mechanism is represented schematically with a pulley.

DETAILED DESCRIPTION OF EMBODIMENTS

A Jacquard machine according to an embodiment of the invention comprises at least two rows of hooks (24), and at least two knives, which each move up and down in counterphase opposite a row of hooks (24) and do or do not take the corresponding hooks (24) along with them.

Figure 1:
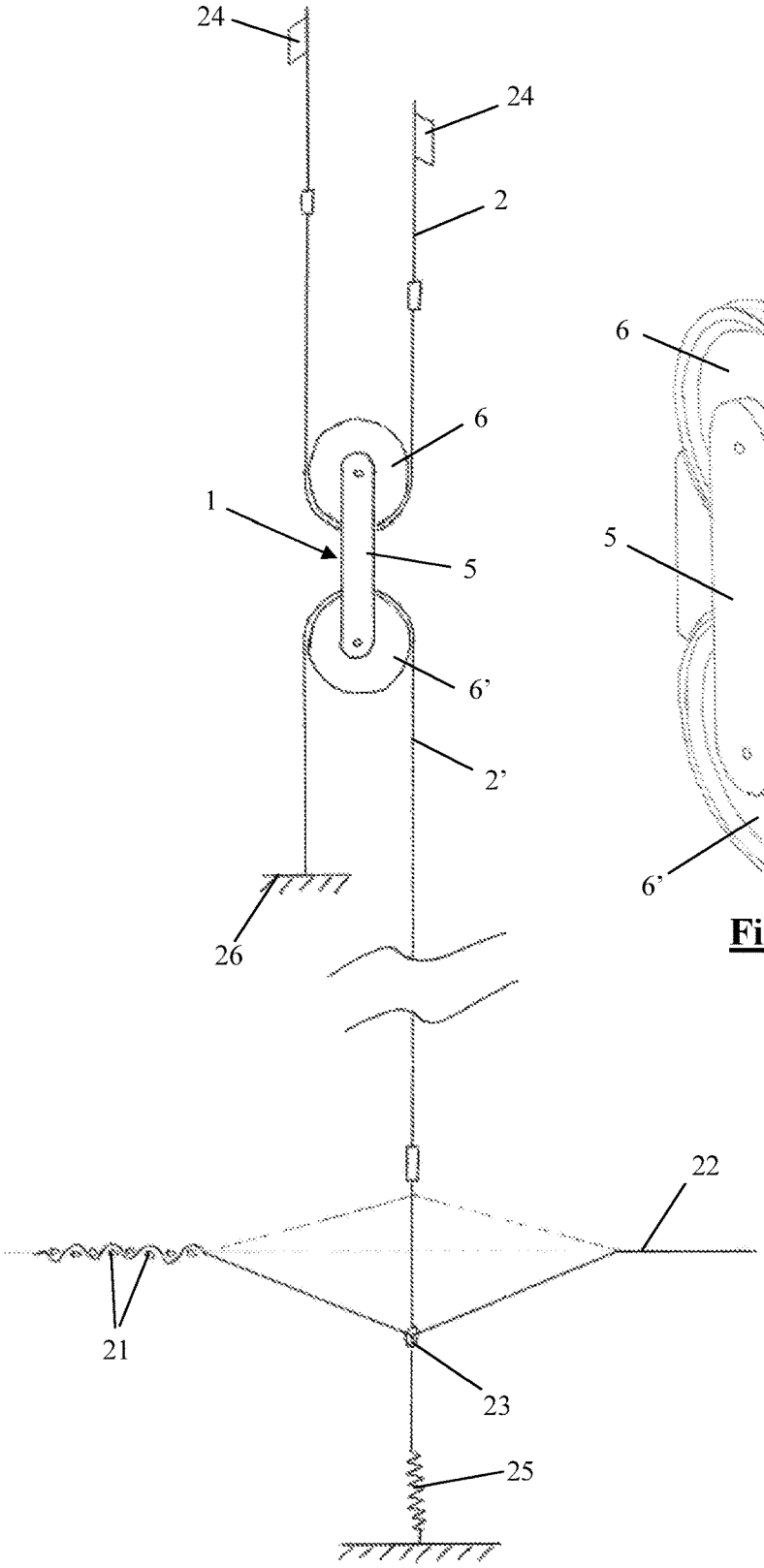

In FIG. 1 two hooks (24) are shown, which each form part of a respective row of hooks (24). These two hooks (24) form a so-called set of hooks.

As shown in FIG. 1, these two hooks (24) are connected to an upper pulley cord (2), which has been passed around an upper pulley wheel (6) of a pulley (1). Around the lower pulley wheel (6') of this pulley (1) a lower pulley cord (2') has been passed. This lower pulley cord (2') is at a first end connected to one or more heddles (23), which are provided with an opening (heddle eye), through which runs a warp thread (22), for adjustment of the position of this warp thread (22). Such a heddle (23) is spring-loaded (25). At a second end, the lower pulley cord (2') is held at a well-defined position (26) in the Jacquard machine. This position (26) can be a fixed position, or can be adjustable, this, for example, with the aid of a control profile. By means of the control profile, the height of the heddle eyes of the Jacquard heddles (23) can be adjusted without the entire Jacquard machine having to be adjusted in height.

By displacement of the hooks (24), via the upper pulley cord (2), also the position of the pulley (1) is altered, and hence, via the lower pulley cord (2'), also the position of the heddle (23) is altered. In this way, the warp thread (22) which is fitted herein can be brought into a desired position in order to realize with the weft threads (21) a desired weave structure having a desired pattern.

In addition to the components depicted in FIG. 1, a pulley mechanism can further also comprise other components, such as, for example, reversing rollers, around which a pulley cord (2, 2') has been passed, harness cords, etc.

The pulley (1) from this pulley mechanism comprises the said pulley wheels (6, 6'), which are each fitted rotatably around a shaft (3).

Figure 2:
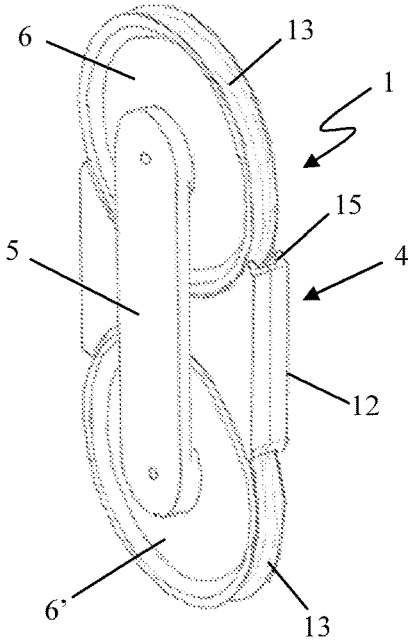
FIG. 2 a particular embodiment of a pulley according to this invention is represented schematically in perspective.

The pulley (1) further comprises flank bodies (5), which are arranged on both sides of the pulley wheels (6, 6') and which form part of a housing (4) for the pulley (1). As can be seen in FIG. 2, these flank bodies (5) can be provided with wings (12), which extend between the pulley wheels (6, 6') in order to better guide a cord (2) passed around a pulley wheel (6, 6'). These wings (12) can possibly also be provided as separate parts of the housing (4).

The shafts (3) and the flank bodies (5) are mutually connected in such a way that the shafts (3) axially secure the flank bodies (5). For this purpose, the shafts (3) are provided with cavities (7, 10, 11) and/or projecting portions, examples of which are given below with some specific embodiments.

The shafts (3) of a pulley (1) according to the invention preferably have a higher resistance to wear than the pulley wheels (6, 6').

The shafts (3) can for this purpose preferentially be produced from metal. This can advantageously be a material which is also used, for example, in hydraulic applications, in precision instruments, in control apparatus etc., so that the availability thereof is high and hence a high-quality product can be realized for a limited cost. More specifically, stainless steel types from the AISI 300 series, for example, such as AISI type 302, 304, 310, 316, etc., preferably in a state denoted by "full hard", are suitable materials for such a shaft (3). Preferably, such a shaft (3) is produced by a drawing process.

In order to be better able to retain lubricants, such a shaft (3) is preferably provided with a porous coating. Such a coating can be, for example, tungsten disulfide.

The pulley wheels (6, 6') are preferably produced from plastic. Here polyoxymethylene (POM) or a nylon (PA6 or PA6.6) can be considered, but for a more durable solution polyether ether ketone (PEEK) can also be considered. To this plastic lubrication additives, such as graphite or teflon (polytetrafluorethylene—PTFE), are preferably added.

In order to be able to better retain lubricants, such a pulley wheel (6, 6') can also be provided with a labyrinth seal (14*a*, 14*b*), of which examples are further given in the specific embodiments.

Figure 5:
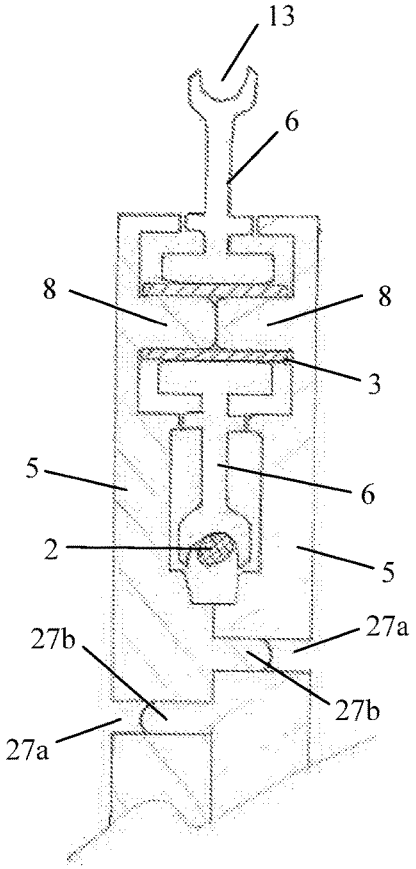
FIG. 5 a part of a variant of the first specific embodiment of a pulley according to this invention is represented schematically in cross section, at the height of a pulley wheel and the connection between two flank bodies.

On its periphery, such a pulley wheel (6, 6') is preferably provided with a slot (13), as shown in FIGS. 2 and 5, in order to guide the pulley cord (2) which has been passed around here.

The housing (4) of a pulley (1) according to an embodiment of the invention is preferably produced from plastic. Polyamide 6.6, whether or not in combination with glass fibre, for example 30% glass fibre, is for example a suitable material for such a housing (4), but also other materials, such as polyamide 6 and polyoxymethylene (POM), qualify as the base plastic.

Preferentially, the housing (4) has been produced by injection moulding. This allows a cheaper choice of material.

At least one flank body (5) of a pulley (1) according to an embodiment of this invention preferably comprises a groove (15), as shown in the particular embodiment in FIG. 2, for the securement of a pulley cord (2, 2') passed around a pulley wheel (6, 6'). This groove preferably extends transversely to the longitudinal direction of the corresponding shaft (3) over the whole of the flank body (5) and here preferably runs, starting from one side of the flank body (5), through to the opposite side thereof. This groove preferably assumes the same curved shape in which the pulley cord (2, 2') is passed around the pulley wheel (6, 6').

The housing (4) is further preferably of two-part design, wherein each flank body (5) forms part of a respective part of the two-part housing (4). The two parts of the two-part housing (4) are preferably virtually identical, so that exchange of the two parts does not affect the assembly. These two parts are further preferably mutually connected using a press fit (27*a*, 27*b*) and/or a click connection, so that an assembly is possible without bonding, heating or extra fastening means, etc. In the embodiment shown in FIG. 5, such a press fit (27*a*, 27*b*) is depicted. For this purpose, the flank bodies (5) are provided with corresponding cavities (27*a*) and grooves (27*b*).

Below, particular characteristics of the specific embodiments shown in FIGS. 3 to 11 are described. In FIGS. 4, 5 and 7-11, respectively only a part of the shown pulley (6, 6') at the height of the uppermost shaft (3) is depicted. In this case, in FIGS. 4 and 8-11, the upper pulley wheel (6) is respectively shown in sectioned representation, and in FIGS. 4, 5 and 8-11 the flank bodies (5) are respectively shown in sectioned representation. The pulley wheel (6) can be further elaborated in a known manner. The flank bodies (5) can be elaborated at the bottom in a manner similar to the shown uppermost part of the flank bodies (5). For the sake of clarity, in FIGS. 4, 8-11 the cross sections of the flank bodies (5) and the associated housing (4) are represented unshaded. In FIG. 5, the cross section of the pulley wheel (6) has been represented unshaded for the sake of clarity.

Figure 3:
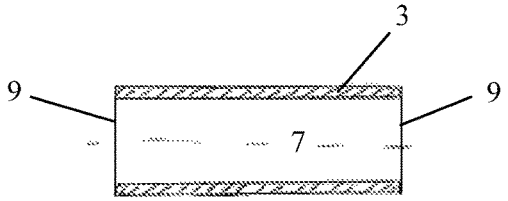
FIG. 3 a shaft of a first specific embodiment of a pulley according to this invention is represented schematically in longitudinal cross section.
Figure 4:
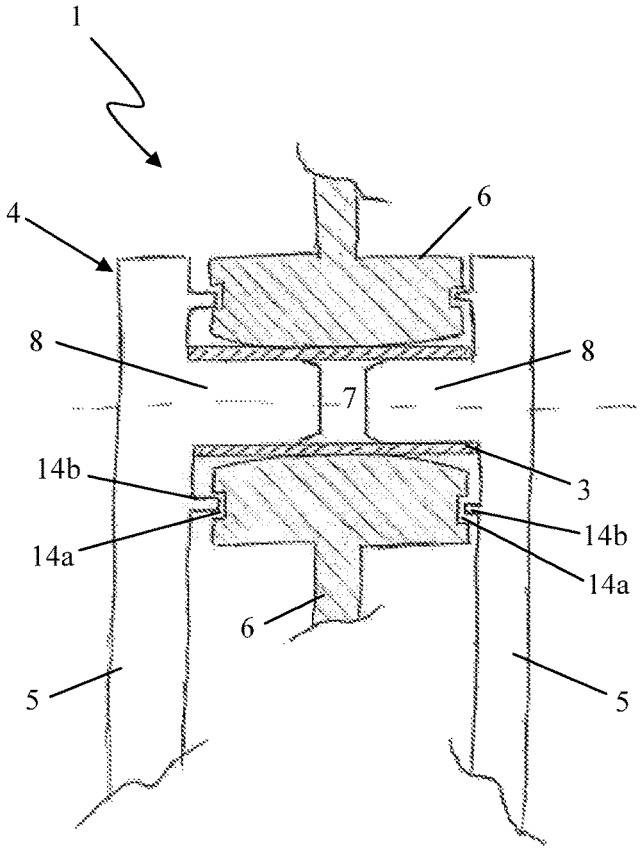
FIG. 4 a part of the first specific embodiment of a pulley according to this invention is represented schematically in cross section, at the height of a shaft, wherein the shaft is sectioned in the longitudinal direction.

In the first embodiment of a pulley (1) according to the invention, shown in FIGS. 3 and 4, and in the variant thereof, shown in FIG. 5, the shown shaft (3) is a circular cylinder having in the centre a concentric cylindrical cavity (7). The flank bodies (5) are each provided with a projection (8), which, via the corresponding access opening (9), engages in the cavity (7) of the shaft (3), as can be seen in FIGS. 4 and 5.

Given that the cavity (7) of the shaft (3) extends through the shaft (3), and given that the shaft (3) has a uniform cross section, this can be produced particularly accurately by drawing or extrusion. The projections (8) of the flank bodies (5) which engage in the cavity (7) of the shaft (3), clamp the shaft (3) frictionally. For this purpose, these projections (8) are fitted in the shaft (3) by a press fit. In FIGS. 4 and 5, these projections (8) are shown as solid. They can also however be realized in hollow design in order to provide cooling, or in order to be able to fit an extra clamping element herein so as to realize a securement.

In the embodiment in FIG. 4, the projections (8) of the flank bodies (5) extend up to a distance apart in the cavity (7) of the shaft (3). In the embodiment in FIG. 5, the projections (8) of the flank bodies (5) together extend over the full length of the cavity (7) of the shaft (3), wherein the projections (8) meet in the centre of this cavity (7).

By virtue of the frictional clamping, not only the flank bodies (5) are axially secured by the shaft (3), but the shaft (3) is also radially secured by the flank bodies (5), so that this shaft (3) cannot rotate with respect to the flank bodies (5).

Figure 6:
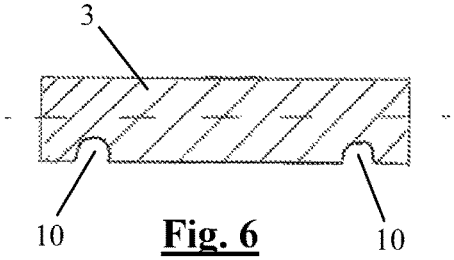
FIG. 6 a shaft of a second specific embodiment of a pulley according to this invention is represented schematically in longitudinal cross section.
Figure 7:
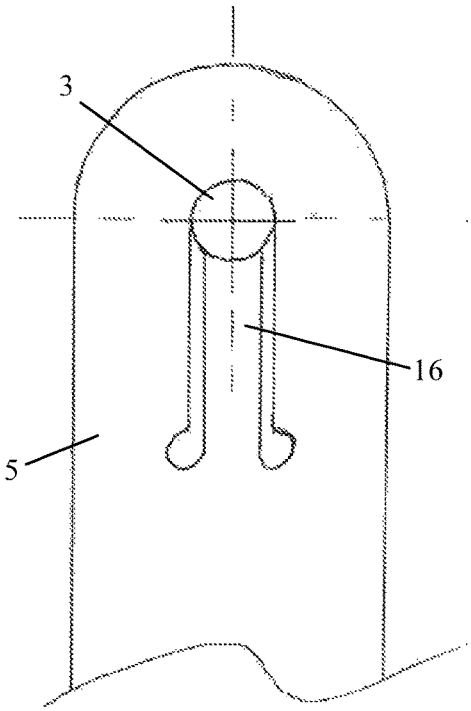
FIG. 7 a part of the second specific embodiment of a pulley according to this invention is represented schematically in side view, at the height of a shaft.
Figure 8:
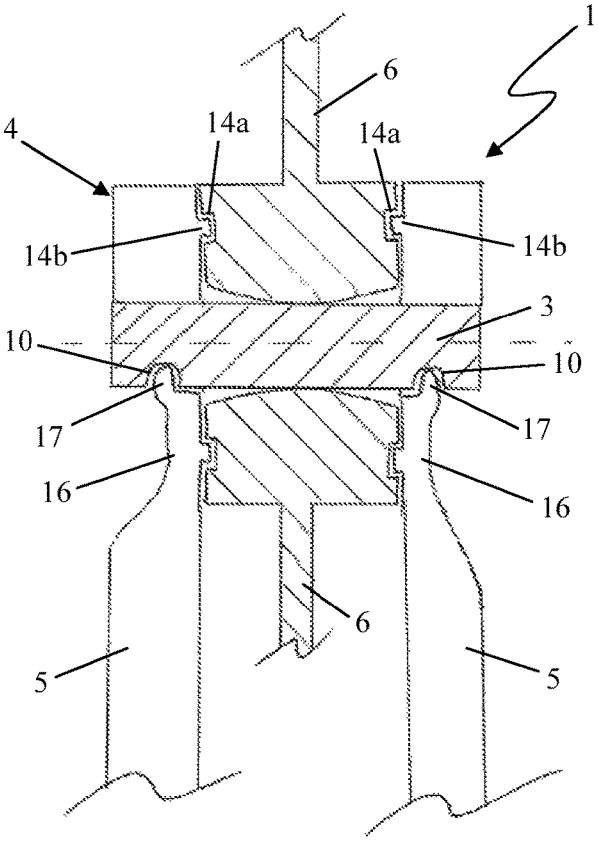
FIG. 8 the part of the second specific embodiment from FIG. 7 is represented schematically in cross section, at the height of the shaft, wherein the shaft is sectioned in the longitudinal direction.

In the second embodiment of a pulley (1) according to the invention, shown in FIGS. 6 to 8, the shaft (3) is provided at the underside with two notches (10), namely one per flank body (5). In each flank body (5) an elastic part (16) is provided, which can elastically deflect with respect to the rest of the flank body (5). This elastic part is provided at the top with a tooth (17), which is fittable in the corresponding notch (10) in the shaft (3). In this way, the shaft (3) and the flank bodies (5) can be mutually connected using a click connection.

By clicking of the tooth (17) of the elastic part (16) into the corresponding notch (10), the flank body concerned is axially secured by the shaft (3). Since the notch (10) is only provided at the underside of the shaft (3), the shaft (3) too is thus radially secured by the flank bodies (5).

In this shown second embodiment, a single notch (10) is provided per flank body. Alternatively, however, a plurality of cavities (10) could also be provided per flank body (5), wherein the flank bodies (5) are provided with corresponding teeth (17).

Figure 9:
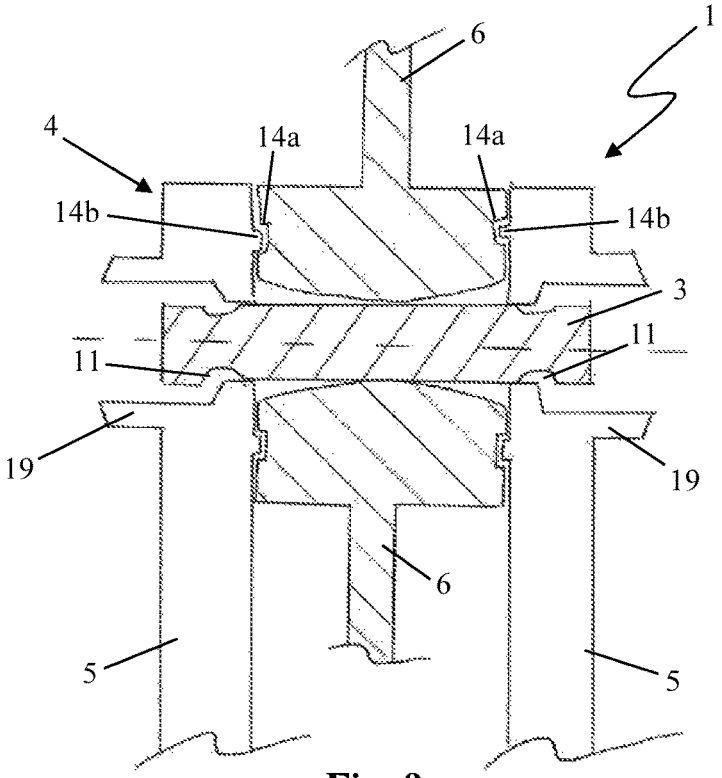
FIG. 9 a part of a third specific embodiment of a pulley according to this invention is represented schematically in cross section, at the height of a shaft, wherein the shaft is sectioned in the longitudinal direction, before the flank bodies have been connected to the shaft by pressing.
Figure 10:
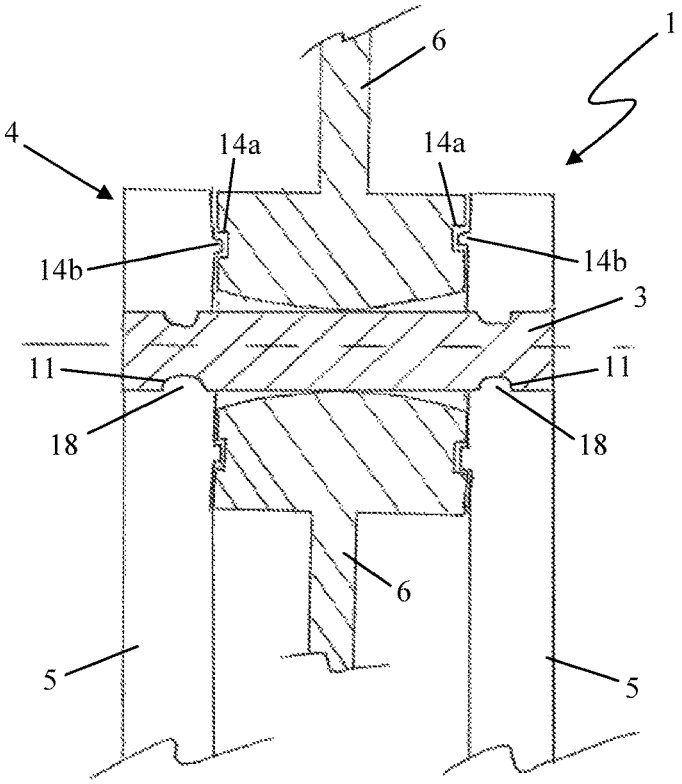
FIG. 10 the part of the third specific embodiment from FIG. 9 is represented schematically in cross section after the flank bodies have been connected to the shaft by pressing, FIG. 11 a part of a fourth specific embodiment of a pulley according to this invention is represented schematically in cross section, at the height of a shaft, wherein the shaft is sectioned in the longitudinal direction.

In the third embodiment of a pulley (1) according to the invention, shown in FIGS. 9 and 10, the shaft (3) is provided with a radial constriction (11) for each flank body (5). As can be seen in FIG. 9, the flank bodies (5), prior to fastening thereof, are provided with material (19) which, as can be seen in FIG. 10, following pressing, transforms into a radial rib (18), which engages in the corresponding radial constriction (11). The thus formed radial ribs (18) engage positively in the corresponding constrictions (11), so that the flank bodies (5) are axially secured by the shaft (3).

By virtue of the pressing, a frictional clamping is also realized, whereby the shaft (3) is also radially secured by the flank bodies (5).

In an alternative embodiment, the shaft (3) can also be provided with a local cavity instead of the shown radial constriction (11). Thus, also a plurality of local cavities can be provided spread over the periphery of the shaft (3), into which cavities material of the flank bodies (5) is pressed analogously by pressing.

Figure 11:
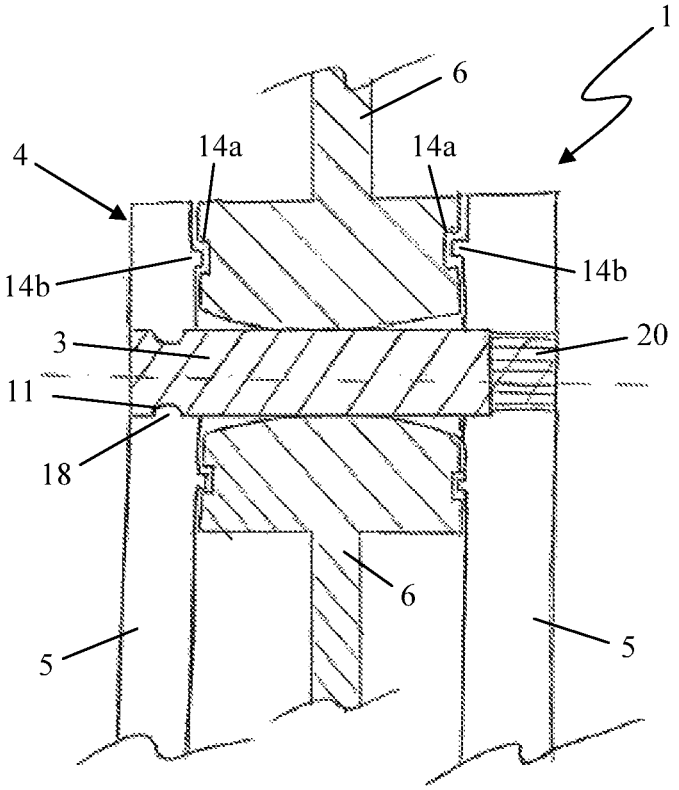

In the fourth embodiment of a pulley (1) according to the invention, shown in FIG. 11, the shaft (3) is provided at a first end, analogously to the third shown embodiment, with a radial constriction (11), in which a radial rib (18) of the corresponding flank body (5) engages by pressing, this with the advantages described above. At its other end, the shaft (3) is provided with a toothing (20), in which material of the corresponding flank body (5) also engages positively, by pressing. In addition to the radial securement as a result of the pressing, the toothing in this case provides for an extra radial securement of the shaft.

In FIGS. 4 and 8-11, the pulley wheel (6) is respectively laterally provided with grooves (14*a*), in which a rib (14*b*) of the flank bodies (5) engages. These together form a labyrinth seal (Ma, 14*b*), which is provided to keep lubricants in the space between the shaft (3), flank bodies (5) and pulley wheel (6). Such a labyrinth seal can also consist of a plurality of and/or more complex groove-rib combinations.

The shown shafts (3) are respectively of one-part design. Alternatively, these could also be realized in multipart design, for example if this simplifies the production thereof or if, with differing materials, differing properties are assigned to these parts.

It is clear that for all embodiments in which cavities and/or constrictions in the shaft, combined with projections of the flank bodies, are mentioned, corresponding embodiments in which projecting parts are provided on the shaft, and cavities and/or constrictions in the flank bodies, are also possible.

The invention claimed is:

1. Pulley for installation in a pulley mechanism of a Jacquard machine, comprising a shaft;

a housing (4), comprising two flank bodies, which are provided to fasten the shaft, so that this shaft extends substantially between the flank bodies and so that the flank bodies are axially secured with the aid of the shaft in both axial directions;

and a pulley wheel, which is provided to be arranged between the two flank bodies so as to be directly rotatable around the shaft;

wherein the shaft, prior to assembly of the pulley, is provided with cavities and/or projecting portions for the post-assembly axial securement of the flank bodies.

2. Pulley according to claim 1, characterized in that the shaft comprises at both its ends an access opening to a said cavity in the shaft, and in that the flank bodies are provided to, via this access opening, engage in the respective cavity.

3. Pulley according to claim 2, characterized in that the shaft is provided with a cavity extending through the shaft, as the said cavity.

4. Pulley according to claim 1, characterized in that the flank bodies are provided for the frictional clamping of the shaft.

5. Pulley according to claim 2, characterized in that each flank body comprises a projection, which is provided to, via the respective access opening, engage in the respective cavity in order to clamp the shaft frictionally.

6. Pulley according to claim 5, characterized in that the said projections of the flank bodies together clamp the shaft over the full inner surface of this shaft.

7. Pulley according to claim 5, characterized in that the said projections of the flank bodies are realized in hollow design.

8. Pulley according to claim 1, characterized in that the shaft is provided with a radial constriction as the said cavity.

9. Pulley according to claim 1, characterized in that the flank bodies are provided to radially secure the shaft.

10. Pulley according to claim 1, characterized in that the shaft is connected to the flank bodies by press fit.

11. Pulley according to claim 1, characterized in that the shaft is coated using a porous coating.

12. Pulley according to claim 1, characterized in that the shaft has a higher resistance to wear than the pulley wheel.

13. Pulley according to claim 1, characterized in that the pulley wheel and the flank bodies are provided with respective grooves and ribs, which together form a labyrinth seal.

14. Pulley mechanism for a Jacquard machine, characterized in that this pulley mechanism comprises a pulley comprising:

a shaft;

a housing, comprising two flank bodies, which are provided to fasten the shaft, so that this shaft extends substantially between the flank bodies and so that the flank bodies are axially secured with the aid of the shaft in both axial directions; and a pulley wheel, which is provided to be arranged between the two flank bodies so as to be directly rotatable around the shaft;

wherein the shaft, prior to assembly of the pulley, is provided with cavities and/or projecting portions for post-assembly axial securement of the flank bodies.

15. Jacquard machine, characterized in that this Jacquard machine comprises a pulley mechanism comprising a pulley, the pulley comprising:

a shaft;

a housing, comprising two flank bodies, which are provided to fasten the shaft, so that this shaft extends substantially between the flank bodies and so that the flank bodies are axially secured with the aid of the shaft in both axial directions; and a pulley wheel which is provided to be arranged between the two flank bodies so as to be directly rotatable around the shaft;

wherein the shaft, prior to assembly of the pulley, is provided with cavities and/or projecting portions for post-assembly axial securement of the flank bodies.

16. Pulley according to claim 1, characterized in that the shaft is provided with a radial thickening as the said projecting portion.

* * * * *